US005573447A

United States Patent [19]

Kozakai et al.

[11] Patent Number: 5,573,447

[45] Date of Patent: Nov. 12, 1996

[54] METHOD AND APPARATUS FOR GRINDING BRITTLE MATERIALS

[75] Inventors: Takashi Kozakai, Tokyo; Hironori Yamamoto, Chigasaki; Nobuo Nakamura; Junji Takashita, both of Yokohama; Toru Imanari, Kawasaki, all of Japan

[73] Assignee: Canon Kabushiki Kaisha, Tokyo, Japan

[21] Appl. No.: 266,350

[22] Filed: Jul. 1, 1994

[30] Foreign Application Priority Data

Jul. 13, 1993 [JP] Japan ..... 5-173307
Jun. 8, 1994 [JP] Japan ..... 6-126388

[51] Int. Cl.[6] ..... B24B 1/00

[52] U.S. Cl. ..... 451/41; 451/28

[58] Field of Search ..... 451/41, 28, 53, 451/63, 285, 290, 278, 292, 548

[56] References Cited

U.S. PATENT DOCUMENTS

| | | | |
|---|---|---|---|
| 3,571,984 | 3/1971 | Koorneef | 451/63 |
| 4,663,890 | 5/1987 | Brandt | 451/292 |
| 4,962,616 | 10/1990 | Wittstock | 451/290 |
| 5,035,087 | 7/1991 | Nishiguchi et al. | 451/285 |
| 5,113,622 | 5/1992 | Nishiguchi et al. | 451/285 |
| 5,297,365 | 3/1994 | Nishioka et al. | 451/41 |
| 5,374,293 | 12/1994 | Takashita et al. | 51/295 |
| 5,435,772 | 7/1995 | Yu | 451/63 |

FOREIGN PATENT DOCUMENTS

| | | | |
|---|---|---|---|
| 3221970 | 9/1988 | Japan | 451/63 |
| 516070 | 1/1993 | Japan . | |
| 5185372 | 7/1993 | Japan . | |

*Primary Examiner*—D. S. Meislin
*Assistant Examiner*—Derris H. Banks
*Attorney, Agent, or Firm*—Fitzpatrick, Cella, Harper & Scinto

[57] ABSTRACT

A brittle-material machining method and apparatus achieves grinding in a ductile mode region using an ordinary grinding apparatus. Grinding or polishing of a workpiece consisting of a brittle material is performed by relative movement between the workpiece and a grinding wheel, which includes innumerable abrasive grains provided on a support base, while the grinding wheel is brought into pressured contact with the workpiece at a prescribed pressure. The grinding or polishing is carried out upon setting the prescribed pressure in such a manner that depth of cut d, into the workpiece, of abrasive grains among the innumerable number thereof that participate in the grinding or polishing is made less than a critical depth of cut $d_c$, which is a minimum depth of cut at which brittle fracture is produced in the workpiece.

26 Claims, 12 Drawing Sheets

METHOD AND APPARATUS FOR GRINDING BRITTLE MATERIALS

BACKGROUND OF THE INVENTION

This invention relates to a method of subjecting a brittle material such as glass, ceramic and crystal material to precise grinding at a constant pressure. More particularly, the invention relates to a method and apparatus for grinding a brittle material used in optical equipment such as cameras, video devices and microscopes.

The term "brittle material" used in the present invention is defined as being a hard and brittle material, namely amorphous materials such as optical glass, quartz glass and amorphous silicon, crystal materials such as fluorite, silicon, KDP, KTP ($KTiOPO_4$) and rock crystal and ceramic materials such as silicon carbide, alumina and zirconia. These materials generally have a fracture and toughness value (critical stress intensity factor) $K_{IC}$ of less than 10 meganewton/$m^{3/2}$.

In a case where these brittle materials are subjected to grinding work, the material often is machined in a "brittle mode region" accompanied by brittle fracture, referred to as cracking or chipping, etc., below the machined surface. However, it is known that if the grinding work is performed upon setting a sufficiently small grinding cutting depth, even these brittle materials can be machined in a "ductile mode region" without the occurrence of cracking and chipping, as in the manner of such metal materials as iron and aluminum.

Whether the grinding work is performed in the "brittle mode region" or the "ductile mode region" is decided by depth of cut per abrasive grain of the grinding wheel used in grinding. The minimum depth of cut at which brittle fracture occurs when the depth of cut is gradually increased from zero is referred to as the "critical depth of cut". This takes on a value that is specific to the material.

In a case where a brittle material such as glass, ceramics or crystal is subjected to precise grinding work under constant pressure, generally use is made of a fine-grain grinding wheel of resin bond or the like exhibiting elasticity. A resin-body grinding wheel is formed by mixing powder of phenol resin, polyimide resin or the like with abrasive grains, applying pressure molding and then baking the result.

According to a manufacturing process for manufacturing a spherical lens by constant-pressure grinding using a conventional contoured grinding wheel having a spherical shape, a pressed blank that has been molded into the shape of the spherical lens is subjected to coarse grinding in one or two stages, after which precise grinding referred to as fine grinding is applied. Finally, polishing by free abrasive grains is performed one or two times to finish the spherical shape. The resin-bonded grinding wheel generally is used as the grinding tool at the time of finishing before polishing referred to as fine grinding.

A precision grinding method with a fixed depth of cut referred to as "ductile-mode grinding" has been investigated in recent years at a number of research facilities. According to this method, the heights of the tips of abrasive grains in a grinding wheel are made uniform by high-precision truing, and use is made of a highly precise, highly rigid machine to mechanically apply a minute depth of cut that is less than the critical depth of cut of the ground material (where the critical depth of cut is that at which the removal of the ground material undergoes a transition from the ductile mode to the brittle mode when the depth of cut applied to the material is gradually increased). It has been clarified that as a result of this method, even brittle materials such as glass can be subjected to grinding work in the ductile mode region in the same way as metals. Further, the specifications of Japanese Patent Application Laid-Open (KOKAI) Nos. 5-16070 and 5-185372 give a detailed disclosure of techniques for grinding in the ductile mode region by truing in which the heights of the tips of the abrasive grains of a grinding wheel are made uniform in a highly precise manner.

However, this conventional method of grinding involves certain problems. Specifically, in a case where grinding is carried out using an elastic bonded grinding wheel such as the resin-bonded grinding wheel, a large number of the fine abrasive grains sink into the bond(material) owing to the elasticity exhibited by the bond itself. The removal of the ground material progresses in small increments by abrasive grains which cut into the ground material and abrasive grains which engage with projections on the surface of the ground material.

More specifically, in the sectional view of FIG. 11 schematically illustrating the state of fine grinding work performed using a resin-bonded grinding wheel 1, abrasive grains 3 are contained in a bond 2 in a sunken state. Since the tips of the exposed abrasive grains 3 are uniform in height to a certain degree, the cutting depths of the individual particles also are substantially uniform. By suitably selecting abrasive grain diameter as well as the elasticity of the bond, the cutting depths of all of the abrasive grains can be made less than critical depth of cut $d_c$, and there are cases in which fine grinding in the above-mentioned ductile mode region can be performed in apparent terms. However, when such a resin-bonded grinding wheel is used, the depth of cut of the abrasive grains differs slightly from particle to particle owing to a difference in the sharpness of the grinding tips of the individual abrasive grains and a difference in the amount of cutting performed by each individual abrasive grain. As a result, there are instances where deeply cutting abrasive grains exceed the critical depth of cut $d_c$, thereby causing a crack K, namely brittle fracture, in a ground material or workpiece 4. The end result is that stable grinding in the ductile mode region cannot be carried out. Further, when grinding proceeds and the surface of the ground material 4 takes on a high degree of flatness in highly precise constant-pressure grinding carried out by a resin-bonded grinding wheel, the abrasive grains 3 are engaged less often so that there is a gradual increase in the abrasive grains that do not participate in the removal of material. Consequently, even if machining time is prolonged, the amount of material removal diminishes to 7 or 8 microns and removal of material in excess of this figure cannot be performed.

Thus, precise grinding carried out by an elastic resin-bonded grinding wheel involves a number of unstable elements and is impractical since a great deal of know-how is required.

In grinding in the ductile mode region mentioned above, a minute depth of cut is set using a highly rigid, high-precision special-purpose machine that relies upon a grinding wheel in which the heights of the tips of the abrasive grains are rendered uniform by high-precision truing. This grinding method allows the machining of brittle materials such as glass in the ductile mode region.

FIG. 12 is a sectional view schematically illustrating the state of machining in ductile mode machining. Here the abrasive grains have been subjected to truing so that the exposed tips thereof have been worked to have a flat shape. In order to make the abrasive grains 3 of the grinding wheel cut into the workpiece 4 accurately by a depth of cut d as illustrated, grinding is carried out by applying a high load and performing positional control in such a manner that cutting will fall within the critical depth of cut $d_c$, which is the limit within which the workpiece 4 will not sustain brittle fracture. In other words, this method of grinding in the ductile mode region requires that the depth of cut d be controlled and set in a highly precise manner. Since the highly rigid special-purpose grinding machine and an accompanying control unit must be prepared for this purpose, the cost of machining becomes very high.

SUMMARY OF THE INVENTION

Accordingly, in view of the problems specific to precision grinding using the conventional elastic resin-bonded grinding wheel and to ductile-mode grinding carried out using a highly-rigid special-purpose grinding machine, an object of the present invention is to provide a method and apparatus for grinding brittle material in which it is possible to perform grinding in the ductile mode region satisfactorily even if an ordinary grinding apparatus is employed.

The present invention attains the foregoing object by providing a precision constant-pressure grinding method for grinding a brittle material by constant-pressure grinding using an electrodeposited or metal-bond type hard bond, characterized by performing grinding by controlling overall load at the time of grinding in such a manner that depth of cut of all abrasive grains (referred to as "active particles") among the abrasive grains of the grinding wheel that take part in grinding is made less than the minimum depth of cut (critical depth of cut $d_c$) at which grinding occurs in the brittle mode.

According to the method of the present invention, the foregoing problems encountered in the prior art are solved by determining a minimum critical load $p_c$ at which brittle fracture occurs and performing actual grinding at a value below this minimum load value.

Two methods of accomplishing this are illustrated in FIGS. 1 and 2.

FIG. 1 is a schematic sectional view illustrating one example of the state of machining in grinding according to the present invention. Here the grinding wheel 1 is urged against the workpiece 4 at a fixed load P while the grinding wheel 1, in which abrasive grains 3 are fixed by a bond 2, is rotated about its rotational axis 5 and the workpiece 4 is rotated about its rotational axis 6. FIG. 1 illustrates the so-called constant-pressure grinding method, in which the cutting depths of all effective abrasive grains 3-1 relative to the workpiece 4 are made smaller than the critical cutting depth $d_c$ of the workpiece by controlling the overall load P. The grinding wheel 1 used in the example of FIG. 1 generally is a hard-bonded grinding wheel such as a readily available electrodeposited grinding wheel (a grinding wheel utilizing a plating technique in which the abrasive grains are fixed on a base plate by plating of nickel, copper or the like) or metal-bonded grinding wheel (a grinding wheel using powder metallurgy in which a metal powder of nickel, copper, iron or the like is mixed with the abrasive grains, after which the result is subjected to pressure molding and sintering). With these grinding wheels, however, the heights of the exposed tips of the abrasive grains generally are not uniform. With the method shown in FIG. 1, therefore, abrasive grains which do not contact the workpiece 4 during machining also exist in the grinding wheel 1, as in the case of abrasive grains 3-2, which are inactive particles.

Accordingly, in the method of deciding the overall load P, the number ($N_{MAX}$) of effective particles present at the surface of contact between the grinding wheel and workpiece and the load per abrasive grain (critical load $P_c$) when the amount of cutting at the critical depth of cut is given in terms of sizing are measured and the overall load in grinding at the critical depth of cut is calculated as $N_{MAX} \cdot P_c$. If the load p applied to a single abrasive grain satisfies the relation $p<p_c$, then grinding in the ductile mode is possible. However, if, under these conditions, the abrasive grains of the grinding wheel simultaneously are irregular in terms of height, the number N of active abrasive grains decreases and falls to $N_{MAX}$ or below, establishing the relation $N \leqq N_{MAX}$. Accordingly, in the case where $p<p_c$ is satisfied, the relation $N \cdot p<N_{MAX} \cdot p_c$ also holds. Here, since $N \cdot p$ represents the overall load (P) at the time of grinding, it will suffice to control the overall load at the time of grinding, in the manner indicated by Equation (1) below, in order to achieve grinding in the ductile mode.

$$P<N_{MAX} \cdot p_c \qquad \text{Eq. (1)}$$

Methods of measuring the critical load $p_c$ and $N_{MAX}$ will now be described.

<Measurement of critical load $p_c$>

When a certain load (p) has been given, the cutting depth (d) of a single abrasive grain with respect to the workpiece is related to the following:

1) load (p) applied to one abrasive grain;

2) a factor (R) decided by such properties as the sharpness and degree of hardness of the abrasive grains;

3) a factor (H) decided by such properties as the degree of hardness and elastic modulus of the workpiece material; and 4) relative velocity (V) between the abrasive grains and the workpiece at the time of grinding.

This may be expressed by d=F(p,R,H,V).

Before grinding is actually applied to a brittle material by the grinding wheel, a machining simulation is carried out in which a model workpiece of the same material as that of the brittle material to actually be ground is subjected to grinding, at the same relative velocity as that at the time of the grinding operation, using a unit model tool to which is attached a single abrasive grain of a type identical with that of the abrasive grains contained in the grinding wheel employed at the time of the grinding operation. The relationship between the load p of one abrasive grain and the depth of cut d is measured in advance through this simulation.

In the machining simulation, the depth of cut (d) of the unit model tool into the model workpiece is varied and the load (p) applied between the unit model tool and model workpiece when machining is being performed at a certain depth of cut (d) is measured, and the relationship between the depth of cut (d) of one abrasive grain and the load (p) is graphed. At the same time, the minimum depth of cut at which brittle fracture occurs is judged based upon observation after machining, and this depth of cut is determined as being the critical depth of cut ($d_c$) of this brittle material.

This machining simulation is carried out with regard to a plurality of unit model tools, and the load per abrasive grain at the time of cut-in by an amount equivalent to the critical depth of cut $d_c$, namely the critical load $p_c$ per abrasive grain, is found from a curve of d vs. p obtained by averaging the individual curves of d vs. p with regard to the factor R decided by the properties of the abrasive grains.

<Measurement of maximum value $N_{MAX}$ of number of active abrasive grains>

To measure the number of active abrasive grains, a planar dummy workpiece of acrylic resin or the like is subjected to scratching by a planar model grinding wheel whose specifications (of the bond and abrasive grains) are identical with those of the grinding wheel actually used to machine the brittle material, and the number of scratches is counted. As for the maximum value $N_{MAX}$ of active abrasive grains, the dummy workpiece is cut from the initial point of contact with the model grinding wheel to the critical depth of cut ($d_c$) of the brittle material to actually be machined, then the model grinding wheel and dummy workpiece are moved a very small distance relative to each other in a direction at right angles to the direction of cut-in, thereby scratching the dummy workpiece. The dummy workpiece is then detached from the apparatus and the number of scratches per unit area is counted by observing the dummy workpiece using a microscope or the like. The product of the number of scratches per unit area and the area of contact between the grinding wheel and the workpiece to actually be machined is adopted as the maximum value $N_{MAX}$ of the active abrasive grains.

Thus, there is provided a precision constant-pressure grinding method for grinding a brittle material by measuring $N_{MAX}$ and $p_c$ and deciding the range of overall load P at the time of grinding, and performing grinding by making the depth of cut of all abrasive grains (active particles) among the abrasive grains of the grinding wheel that take part in grinding less than the minimum depth of cut (critical depth of cut $d_c$) at which grinding occurs in the brittle mode. Also provided is a precision constant-pressure grinding apparatus for performing grinding using this method.

FIG. 2 is a schematic sectional view illustrating one more example of the state of machining in grinding according to the present invention. The general features of grinding in the method shown in FIG. 2 are the same as those of grinding in FIG. 1 and need not be described again in detail. According to the features of the method shown in FIG. 2, the grinding wheel 1 used is one in which the heights of the tips of the abrasive grains 3 are made uniform, to a high degree of accuracy, at a level sufficiently smaller than the value of the critical depth of cut $d_c$ of the workpiece 4 in the manufacturing process beforehand. According to this method, the cutting depths of the abrasive grains 3 are equal for all particles and the inactive abrasive grains shown in FIG. 1 are non-existent.

In order to manufacture a grinding wheel in which the heights of the tips of the abrasive grains are made uniform beforehand, use can be made of a grinding wheel manufacturing method of the kind described in Japanese Patent Application No. 5-96040 proposed by the inventors, by way of example. According to this proposed method, use is made of a mold whose shape is the replica of that of the grinding surface of the grinding wheel to be manufactured. The surface abrasive grains of the mold are dispersed, a bonding layer of metal plating or the like is formed to cover the abrasive grains and the result is adhered to the surface of the base member of the grinding wheel. The resulting bonding layer is then peeled off the mold. The bonding layer, whose surface is the reverse of the shape of the mold, is etched so that the abrasive grains protrude from the bonding layer.

In order to perform grinding in the ductile mode region, the load (p) applied to a single abrasive grain should be made less than the critical load. In other words, it should be arranged so that the relation $p<p_c$ will hold.

As shown in FIG. 2, the tips of the abrasive grains in the grinding wheel are uniform in height, as a result which the cutting depths of the abrasive grains are all equal. Accordingly, if N represents the number of active abrasive grains, then $p=p\cdot N$ will hold. Therefore, by setting P (total load at grinding) within the range indicated by Equation (2) below, the load p applied to one abrasive grain will be less than the critical load $p_c$ and grinding can be performed in the ductile mode using the conventional constant-pressure grinding machine.

$$P<p_c\cdot N \qquad \text{Eq. (2)}$$

Further objects, features and advantages of the present invention will become apparent from the following detailed description of embodiments of the present invention with reference to the accompanying drawings.

DESCRIPTION OF THE PREFERRED EMBODIMENTS

Specific embodiments of the present invention for obtaining various conditions under which grinding in the ductile mode region can be performed satisfactorily using an ordinary grinding apparatus will now be described with reference to the accompanying drawings.

Figure 1:
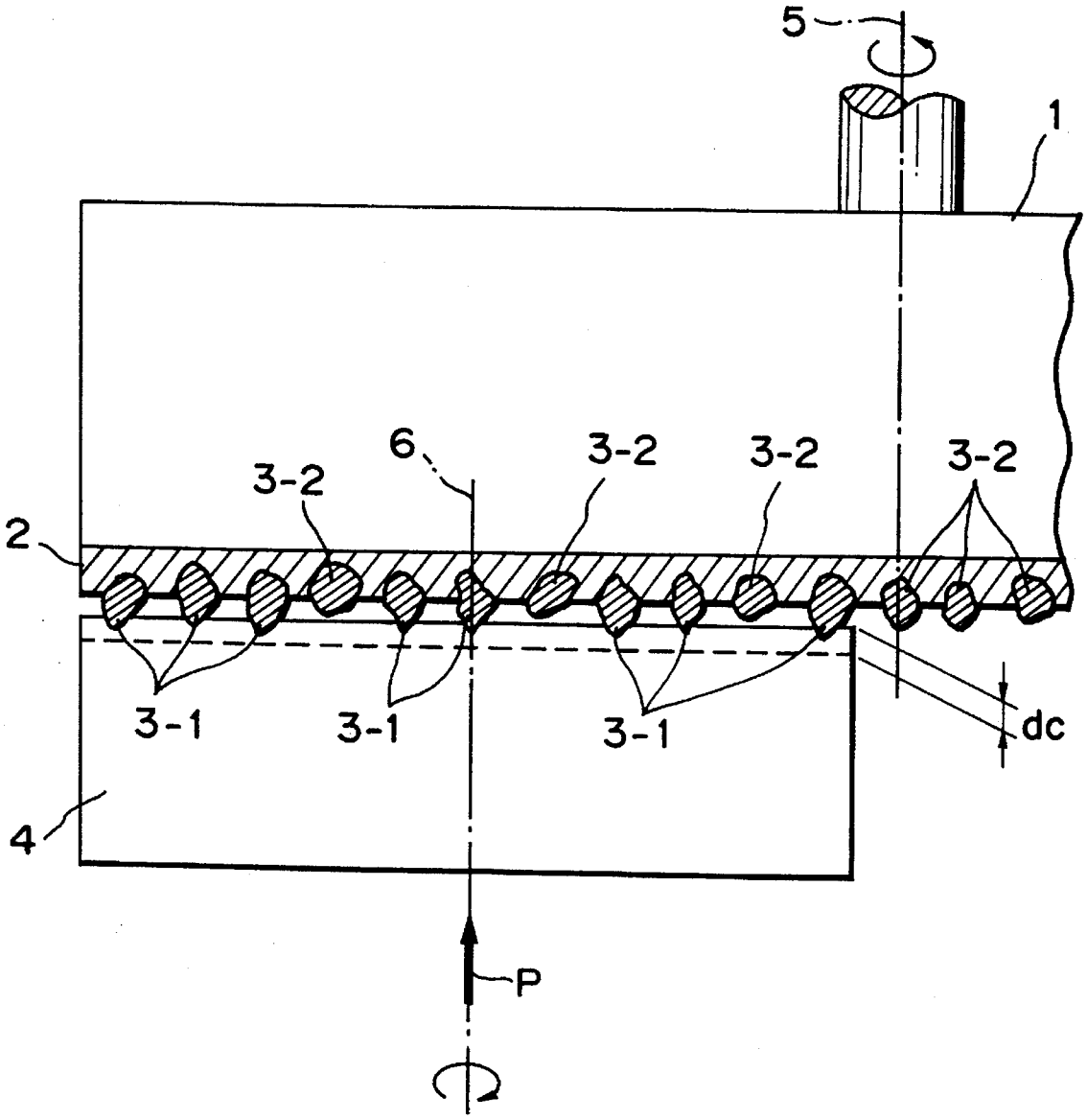
FIG. 1 is a schematic sectional view illustrating an example of the state of machining in grinding according to the present invention.
Figure 2:
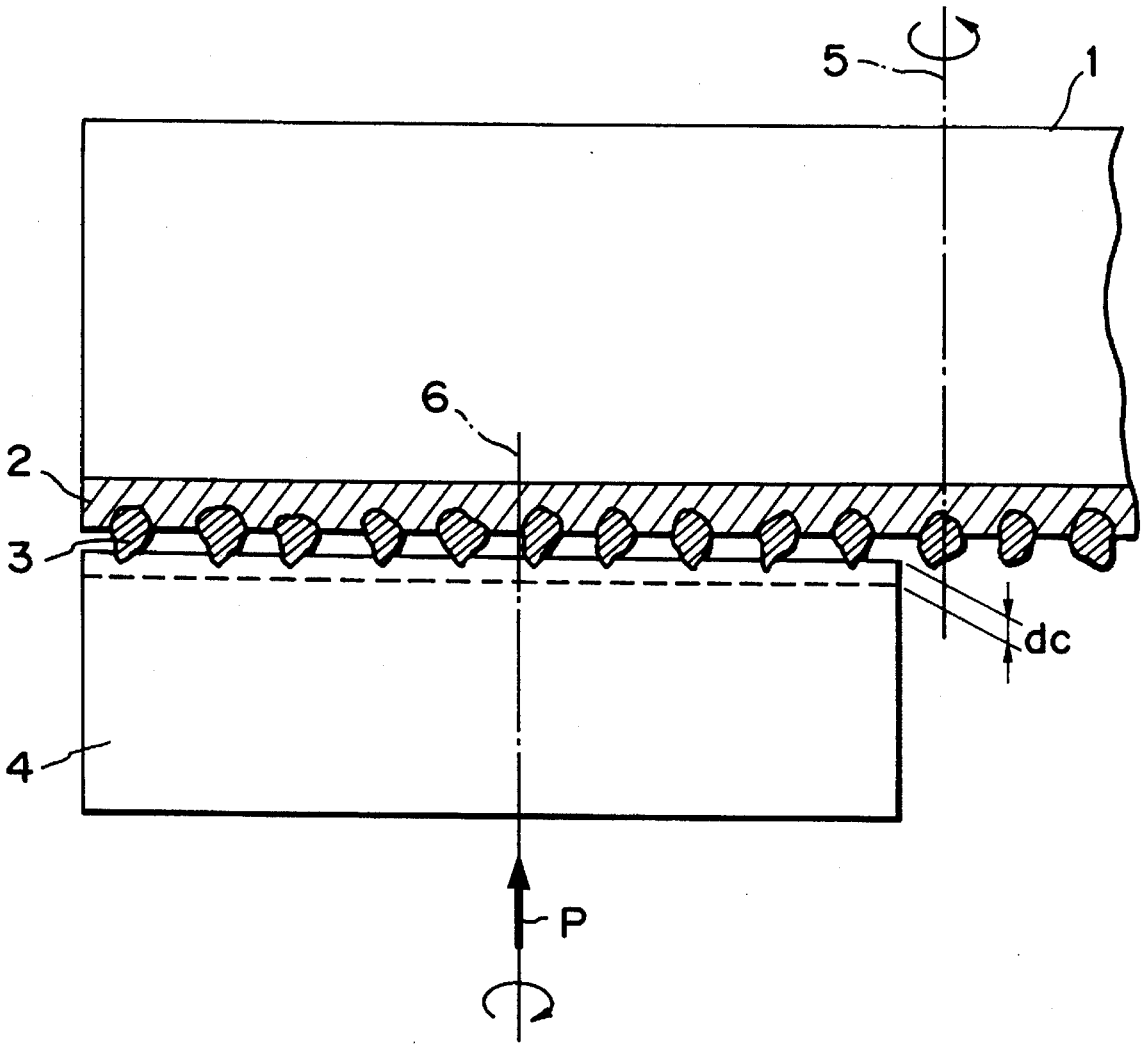
FIG. 2 is a schematic sectional view illustrating one more example of the state of machining in grinding according to the present invention.
Figure 3A:
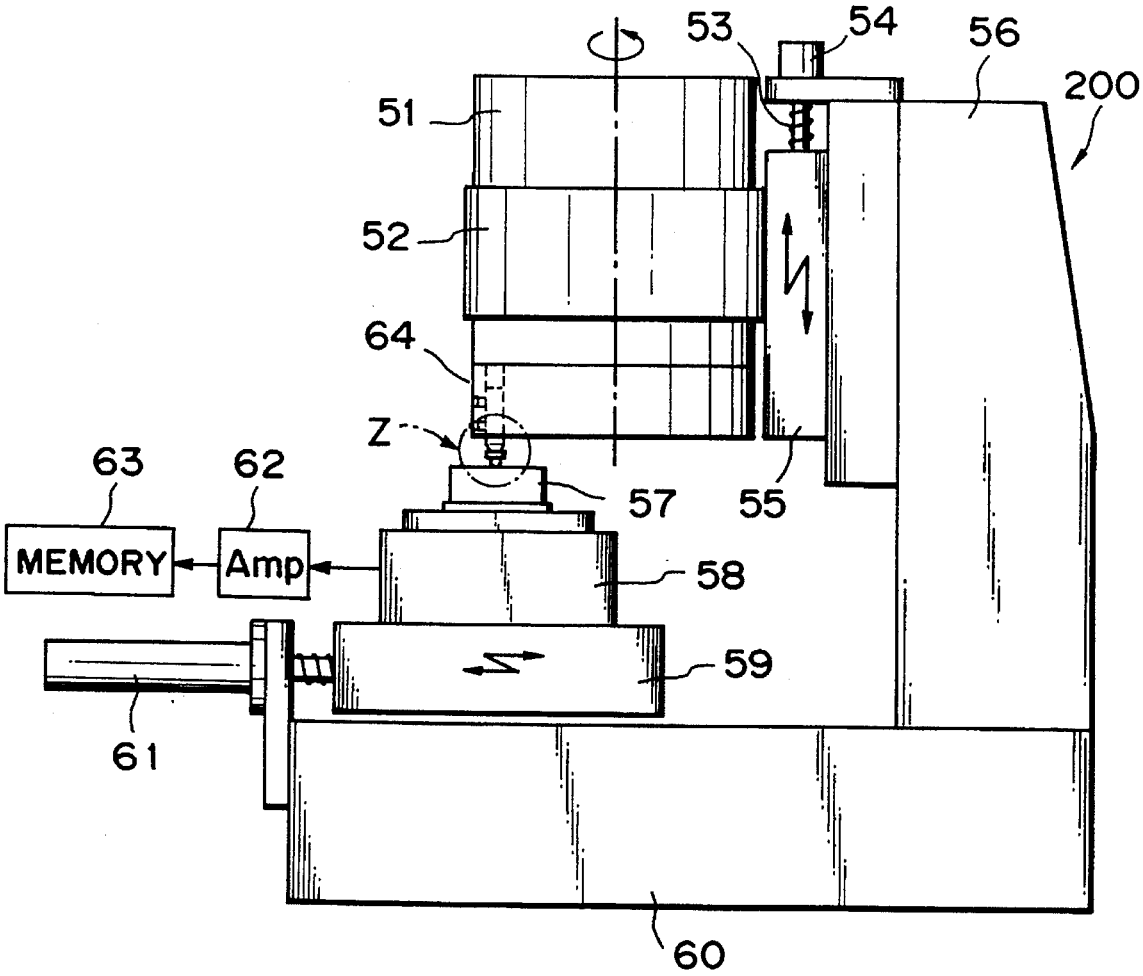
FIG. 3A is a front view of a first apparatus for measuring depth of cut and load of abrasive grains.
Figure 3B:
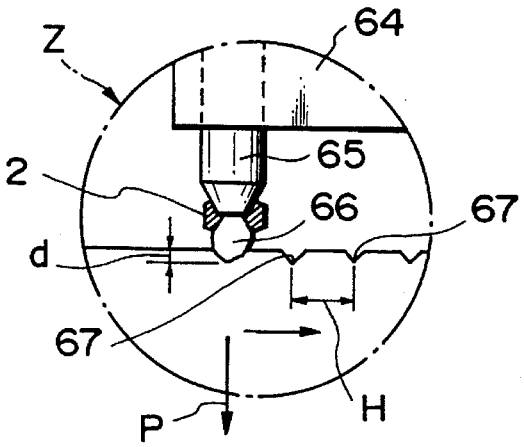
FIG. 3B is an enlarged view of a portion C in the first apparatus.

FIG. 3A is a sectional view showing a first apparatus 200 for measuring critical load and critical depth of cut using one abrasive grain constituting a grinding wheel, and FIG. 3B is an enlarged view of a portion Z in the first apparatus 200. The apparatus 200 includes a vertical positioning slide 55 supporting an air bearing 52, a tool mounted on the air bearing 52 and a table 59 on which a workpiece 57 is placed. The workpiece 57 is moved by moving the table 59 and is machined by the mounted tool. The vertical positioning slide 55 is mounted on a column 56 and positioned by a ball screw 53 and motor 54.

The table 59 is mounted on a base plate 60 and driven by an air cylinder 61. A load sensor 58 for measuring load at the time of machining is mounted on the table 59 and the measured load is recorded by a recorder (memory) 63 after the output of the sensor 58 is amplified by an amplifier 62.

As for the method of measuring the relationship between the load p and the depth of cut d, a tool shank 65, to which an abrasive grain 66 of the same type as that contained in a grinding wheel actually used to performing grinding has been brazed, is mounted in a tool holder 64. The holder 64 is mounted on the air bearing 52. The air bearing 52 is set by the vertical positioning slide 55 at a position at which the abrasive grain 66 will cut into the workpiece 57 by an amount equivalent to the depth of cut d, after which the table 59 is moved by the air cylinder 61 at a speed for achieving an amount of feed H per revolution of the tool. As a result, cutting grooves 67 is intermittently machined in the workpiece 57 in spiral fashion. The force applied to the workpiece 57 at the time of this machining is detected by the load sensor 58.

Figure 4:
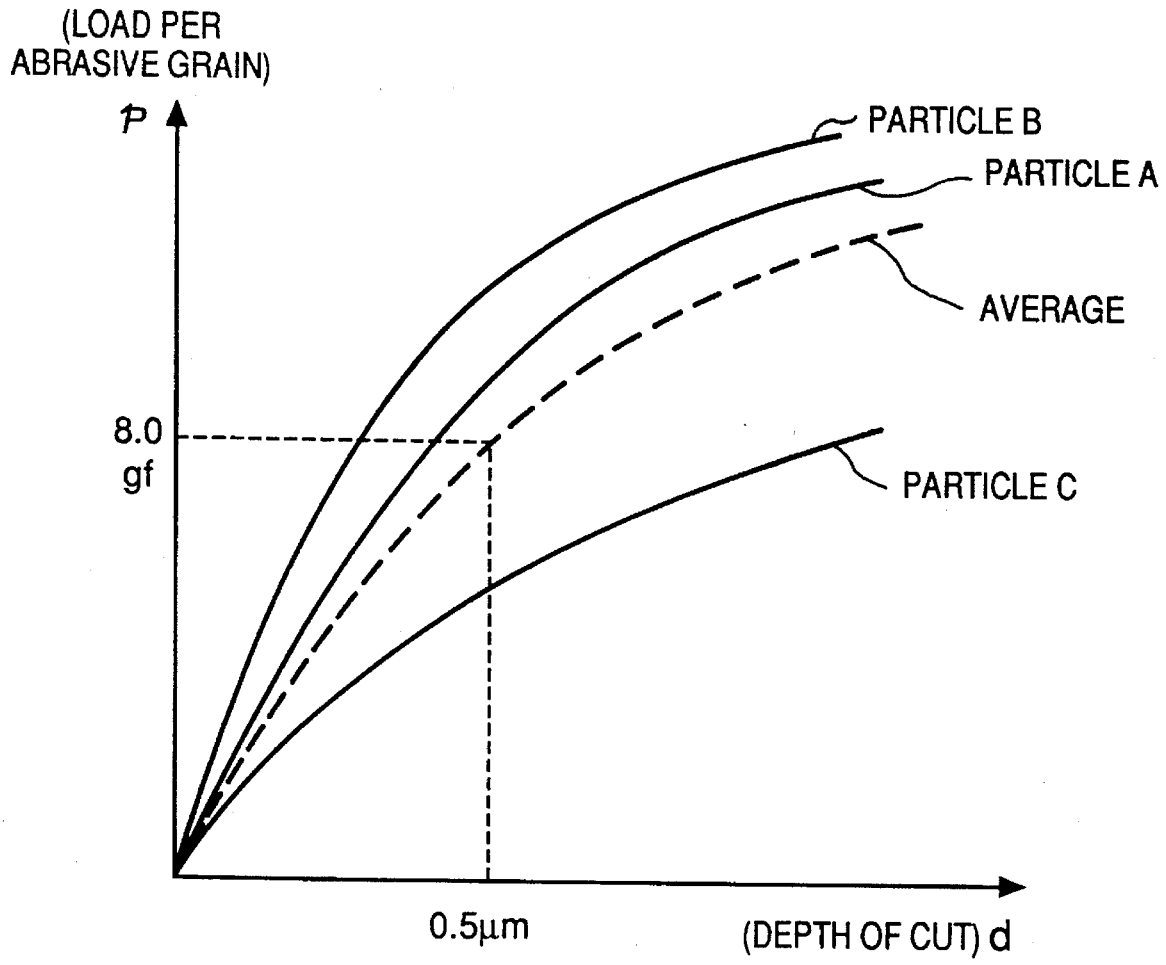
FIG. 4 is a graph illustrating an example the correlation between depth of cut and load of abrasive grains.

This machining is carried out several times while changing the depth of cut d each time. Alternatively, the machining is performed by varying the depth of cut d continuously during one machining operation. The relationship between depth of cut d and load p is obtained as a result. A graph can be drawn showing the correlation between load and depth of cut, as depicted in FIG. 4 by way of example. As the depth of cut d in enlarged, there is a transition from the ductile mode in which the cutting groove 67 does not crack to the brittle fracture mode accompanying by cracking in the bottom of the groove or in the vicinity thereof. By reading the depth of cut d when fracture occurs in the brittle fracture mode, the critical depth of cut $d_c$ of the workpiece 57 can be measured.

In actuality, p was measured while varying d using abrasive grains A, B and C of the same material and type and equal particle diameter in the first apparatus 200 of FIG. 3A according to the first example, and the results were graphed as illustrated in FIG. 4. Particle diameter of the abrasive grains in this example was about 100 μm, and the workpiece material was crown glass manufactured by Ohara K.K.

As will be understood from FIG. 4, the d–p curves for the abrasive grains A, B, C differ from one another significantly owing to such abrasive grain properties as roundness of the particle edge and particle direction even though machining was performed by abrasive grains having the same particle diameter. Accordingly, in order to decide the critical load, it is necessary to perform measurement with regard to several different abrasive grains and then obtain an average value. For example, if the critical depth of cut is 0.5 μm, it will be understood that $p_c$ is 0.078N (8 gf) based upon the average of the particles A, B, C shown in FIG. 4. Thus it was possible to obtain the critical depth of cut $d_c$ for one abrasive grain as well as the load $p_c$ prevailing at this time.

Figure 5:
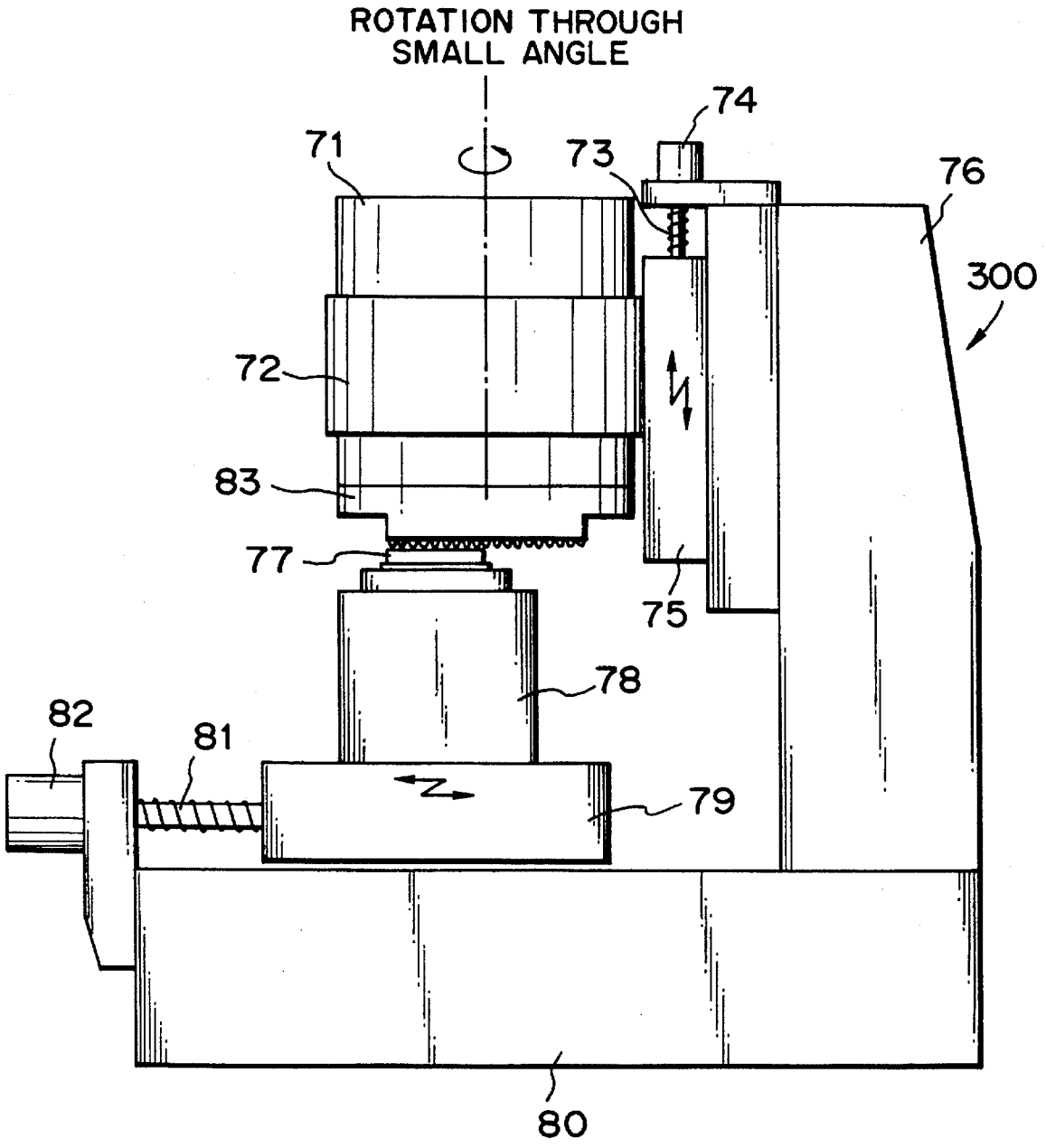
FIG. 5 is a front view of a second apparatus for measuring a number of active abrasive grains.

The maximum number of active abrasive grains is measured using a second apparatus 300 illustrated in FIG. 5. The apparatus 300 includes a vertical positioning slide 75 supporting an air bearing 72, a tool mounted on the air bearing 72 and a table 79 on which a workpiece 77 is placed. The workpiece 77 is moved by moving the table 79 and is machined by the mounted tool. The vertical positioning slide 75 is mounted on a column 76 and positioned by a ball screw 73 and motor 74.

The air bearing 72 is rotated by a motor 71 and can be positioned over very small angles by an angle detector (encoder), not shown, accommodated within the motor.

The table 79 is mounted on a base plate 80 and driven by a ball screw 81 and motor 82.

As for the method of measuring the maximum number of active abrasive grains, a grinding wheel 83 fabricated to a planar shape by a manufacturing method identical with that for a grinding wheel actually used in machining, and having the same specifications, is attached to the air bearing 72 of the apparatus shown in FIG. 5, a dummy workpiece 77 of acrylic resin or the like having a planar shape is mounted on the table 79 via a workpiece base 78, and the table 79 is positioned in such a manner that the dummy workpiece 77 is situated beneath the grinding wheel 83. The vertical positioning slide 75 is lowered to contact the dummy workpiece 77 and then is lowered further by the critical depth of cut $d_c$ of the brittle material machined from the position of initial contact. The vertical positioning slide 75 is then halted.

Figure 6:
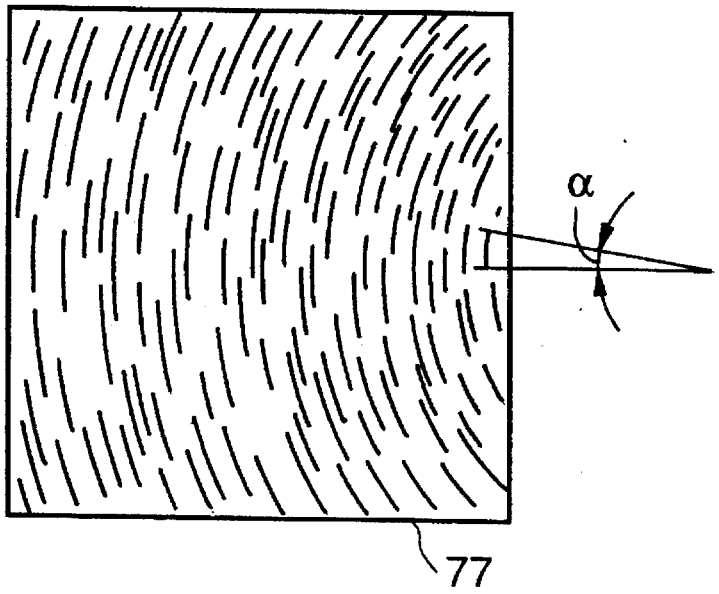
FIG. 6 is a diagram showing the tracks of scratches produced in acrylic resin by a grinding wheel using the apparatus of FIG. 5.

At this position the air bearing 72 is rotated by the motor 71 through a very small angle α, e.g., 1~10°, and the vertical positioning slide 75 is raised, whereupon scratches of the kind shown in FIG. 6, for example, are left in the dummy workpiece 77.

These scratches are tracks left when the abrasive grains of the grinding wheel 83 cut away the dummy workpiece. By counting the number of these scratches it is possible to measure the number of abrasive grains ($N_{MAX}$) in a height range from the most protruding abrasive grains to the critical depth of cut $d_c$ over the area $S_0$ of the dummy workpiece. The maximum number of active abrasive grains $N_{MAX}$ is represented by $N_{MAX}=(N_{MAX})\times S/S_0$ based upon the area of contact S between the grinding wheel and the workpiece actually machined.

Figure 7:
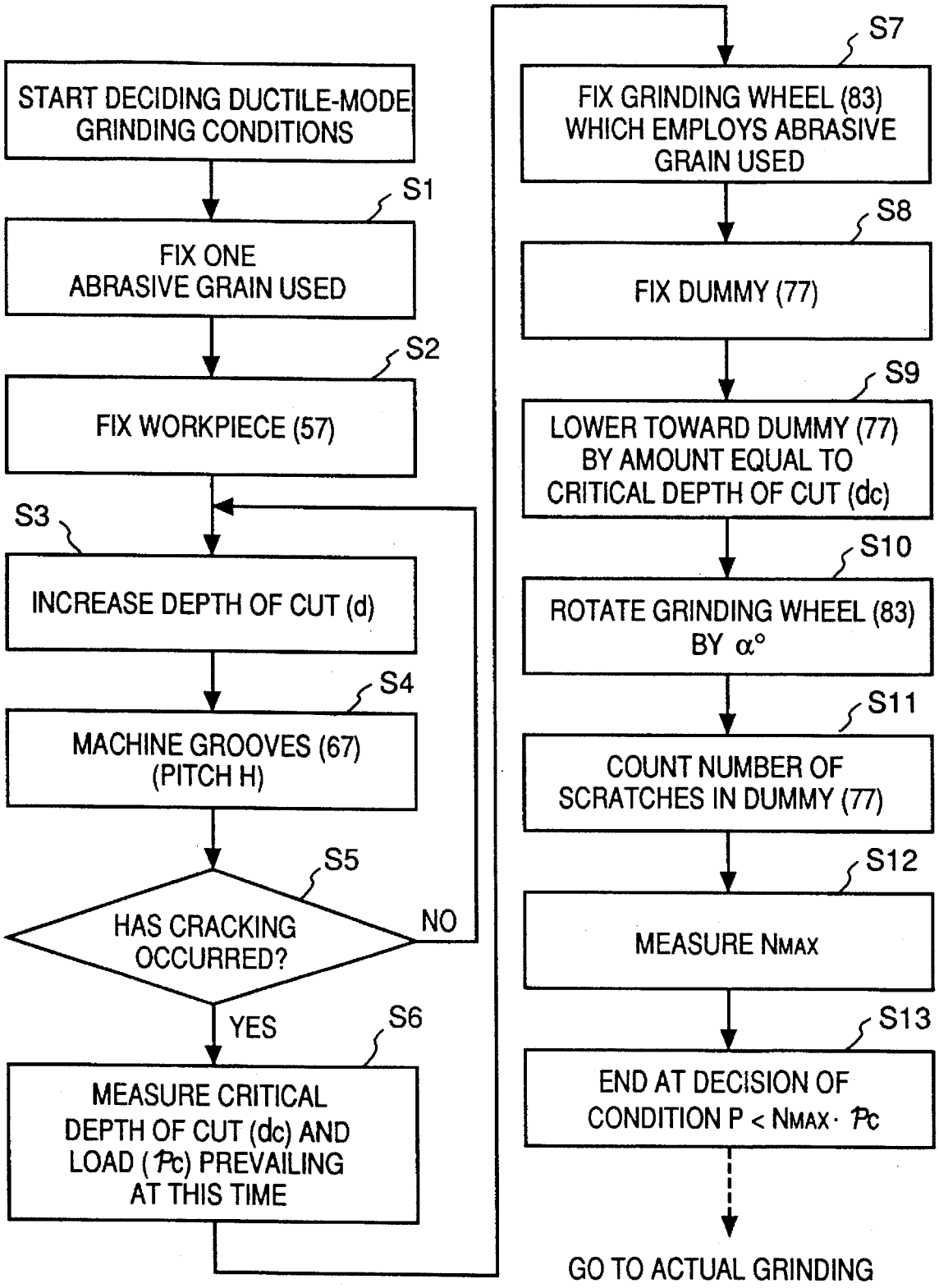
FIG. 7 is a flowchart of processing for deciding ductile-mode grinding conditions.

The foregoing is summarized in the flowchart of FIG. 7 showing processing for deciding ductile-mode grinding conditions. Specifically, at step S1 of the flowchart, one abrasive grain of a grinding wheel actually used is secured using the first apparatus 200 described above. Next, the workpiece 57 actually subjected to grinding is secured at step 2 using the apparatus 200, then the load p is measured at step S3 while increasing the depth of cut d. The groove 67 is cut into the workpiece 57 at step S4 and it is determined at step S5 whether cracking K has occurred. If cracking K has occurred, then the program proceeds to step S6. Here the critical depth of cut $d_c$ prevailing at the moment cracking K occurs and the pressure $p_c$ at this time are measured. The graph showing the correlation illustrated in FIG. 4 is obtained.

Next, at step S7, the grinding wheel 83 to which innumerable ones of the above-described abrasive grains have been fixed is secured on the support base using the second apparatus 300, the dummy 77 is secured at step S8 and the grinding wheel is lowered to the dummy 77 at step S9 by an amount equivalent to the critical depth of cut $d_c$. The grinding wheel 83 is rotated through an angle α at step S10 and the number of scratches are countered at step S11. On the basis of the area of contact S between the workpiece and the grinding wheel, the maximum number of active abrasive grains $N_{MAX}$ is obtained from $N_{MAX}=(N_{MAX})\times S/S_0$ (step S12). The ductile-mode grinding condition is found at step S13.

Figure 8:
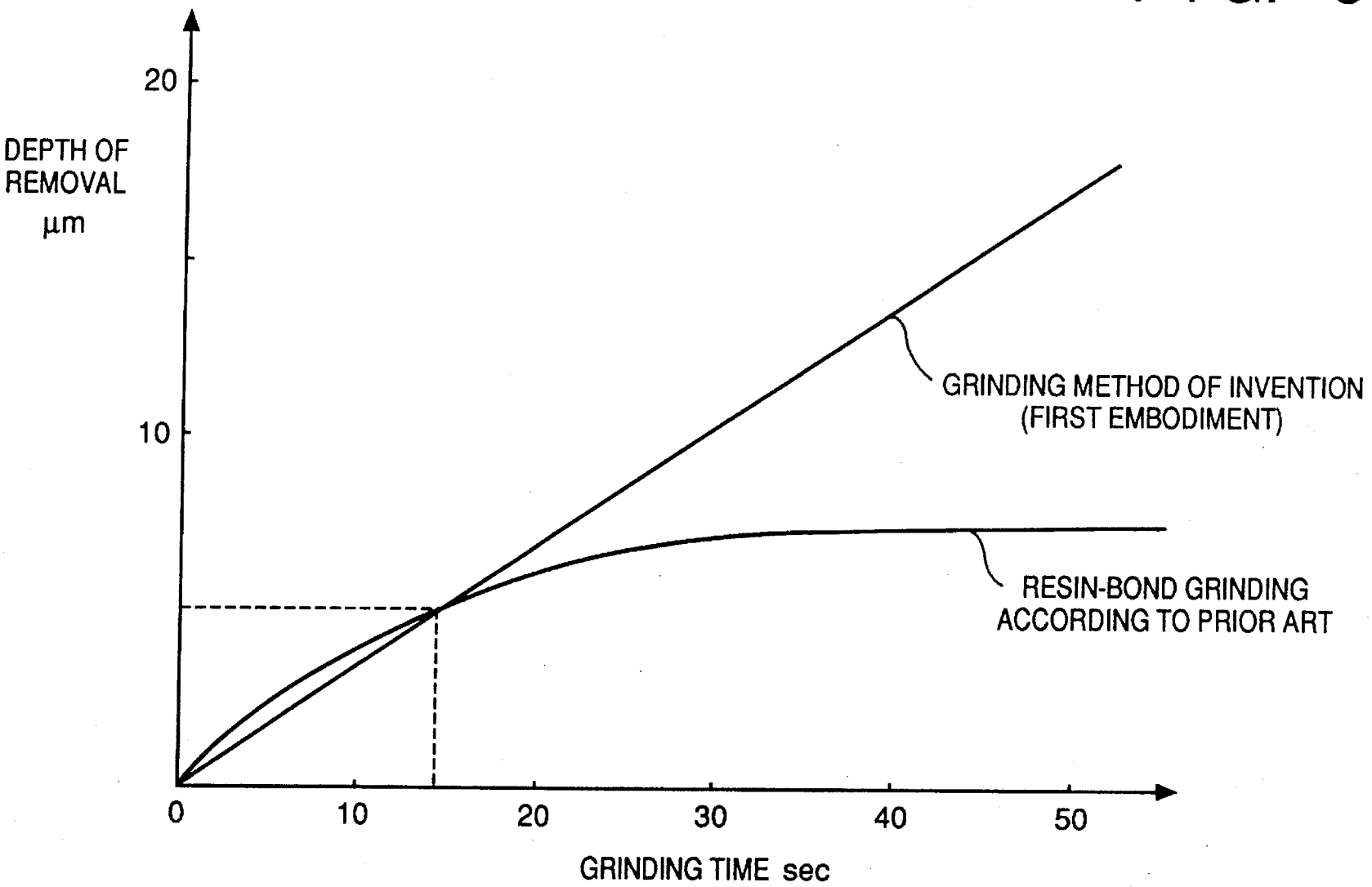
FIG. 8 is graph showing the relationship between depth of removal and grinding time for grinding under ductile-mode grinding conditions and grinding with a resin-bonded grinding wheel.

FIG. 8 is graph showing the relationship between the amount of removal and grinding time for grinding under the ductile-mode grinding conditions, obtained as set forth above, and grinding with a resin-bonded grinding wheel according to the prior art. With conventional grinding using resin-bonded grinding wheel, the amount of removal up to about 14 seconds surpasses that by grinding under the ductile-mode grinding conditions but saturates after 14 seconds. By contrast, it was verified that grinding under the ductile-mode grinding conditions, in which the amount of removal increases substantially linearly, provides greater removal of material.

In order to prevent the abrasive grains from falling out in the course of grinding, using a hard-bonded grinding wheel in which the Vickers hardness of the bonding material is greater than 300 is more effective than making use of an electrodeposited or metal-type bond materials. The hard-bonded grinding wheel makes it possible to grind a brittle material in the ductile mode stably over an extended period of time.

Figure 9:
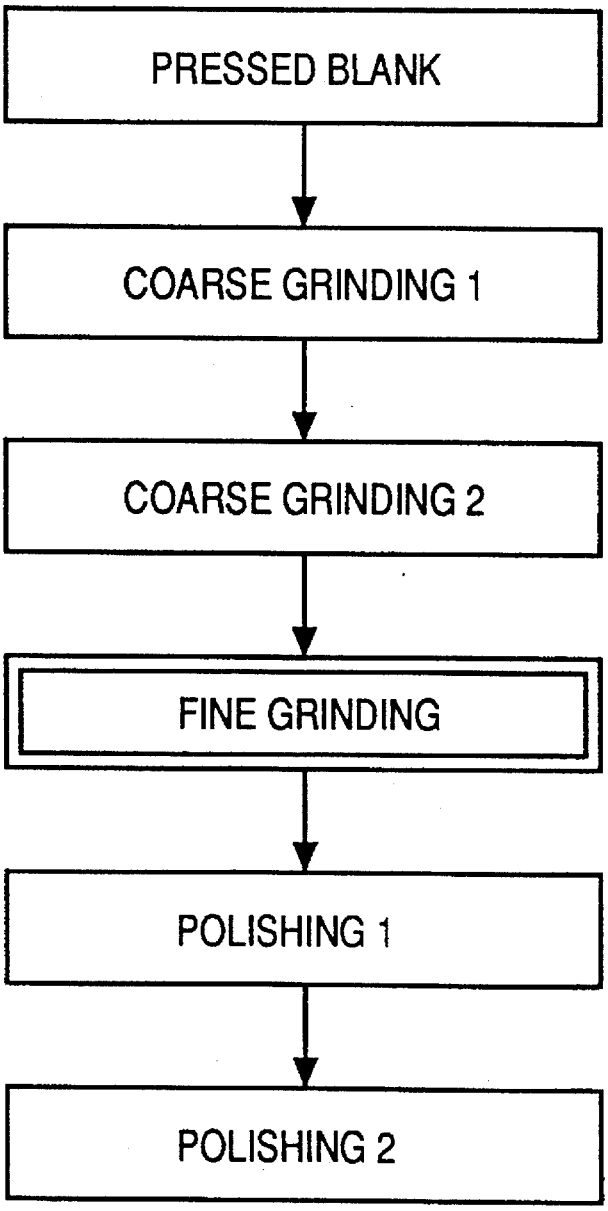
FIG. 9 is a flowchart of a process for manufacturing a spherical lens.

FIG. 9 is an example of a flowchart illustrating a process for manufacturing a spherical lens by constant-pressure grinding using a spherically shaped grinding wheel. The method of manufacturing this spherical lens includes coarsely grinding a pressed blank in one or two stages, then applying precision grinding referred to as fine grinding and finally carrying out polishing by free abrasive grains one or two times to finish the spherical shape. At this time a resin-bonded grinding wheel is used as the grinding tool to perform finishing before polishing referred to as fine grinding. In the illustrated example, however, this process was carried out using not the conventional resin-bonded grinding wheel but a nickel-type metal-bond contoured spherical grinding wheel having a high degree of hardness. The abrasive grains of the grinding wheel were diamond particles having an average particle diameter of 50 μm.

Figure 10:
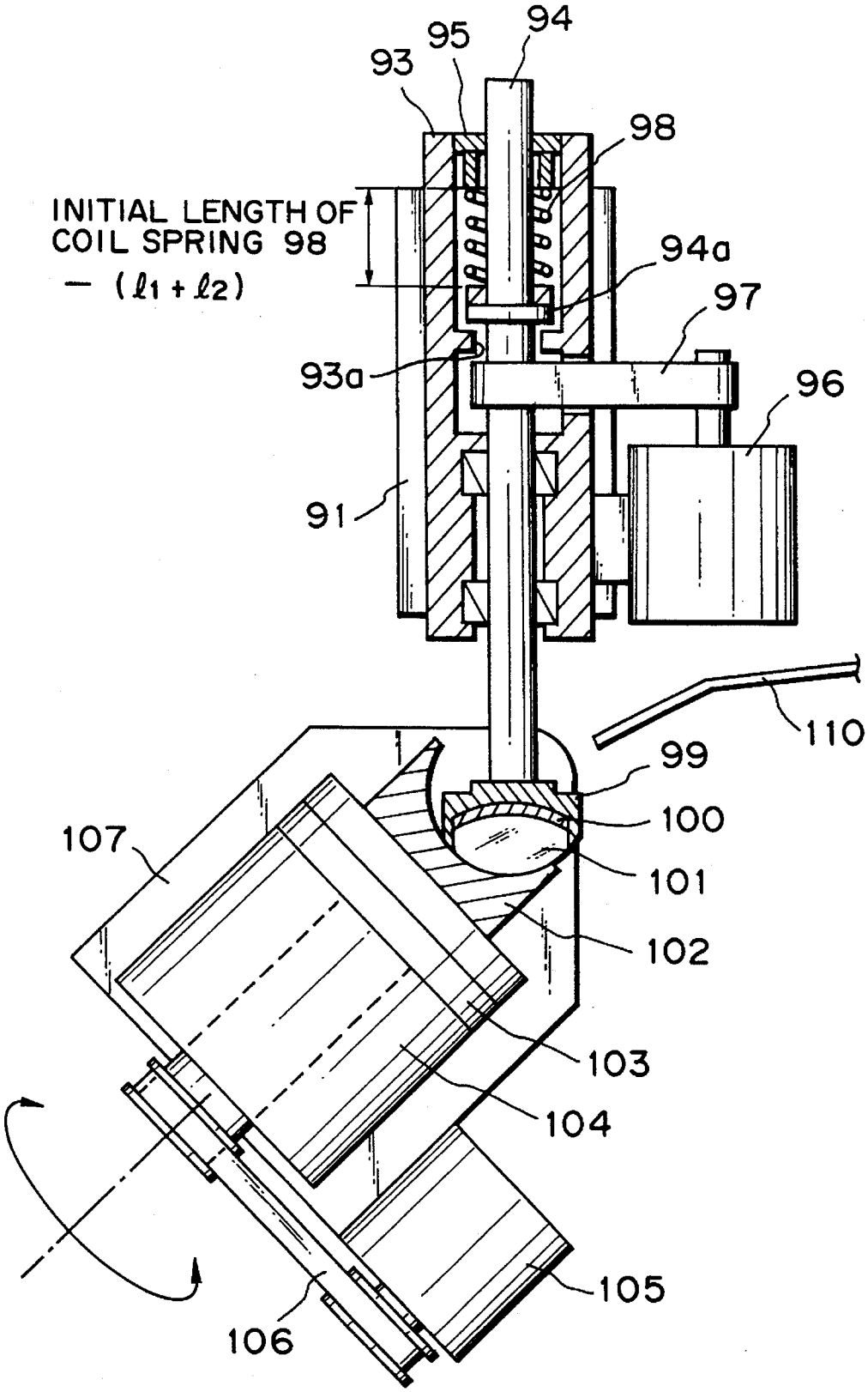
FIG. 10 is a schematic sectional view showing a lens spheric center oscillation movement type spherical surface processing machine.
Figure 11:
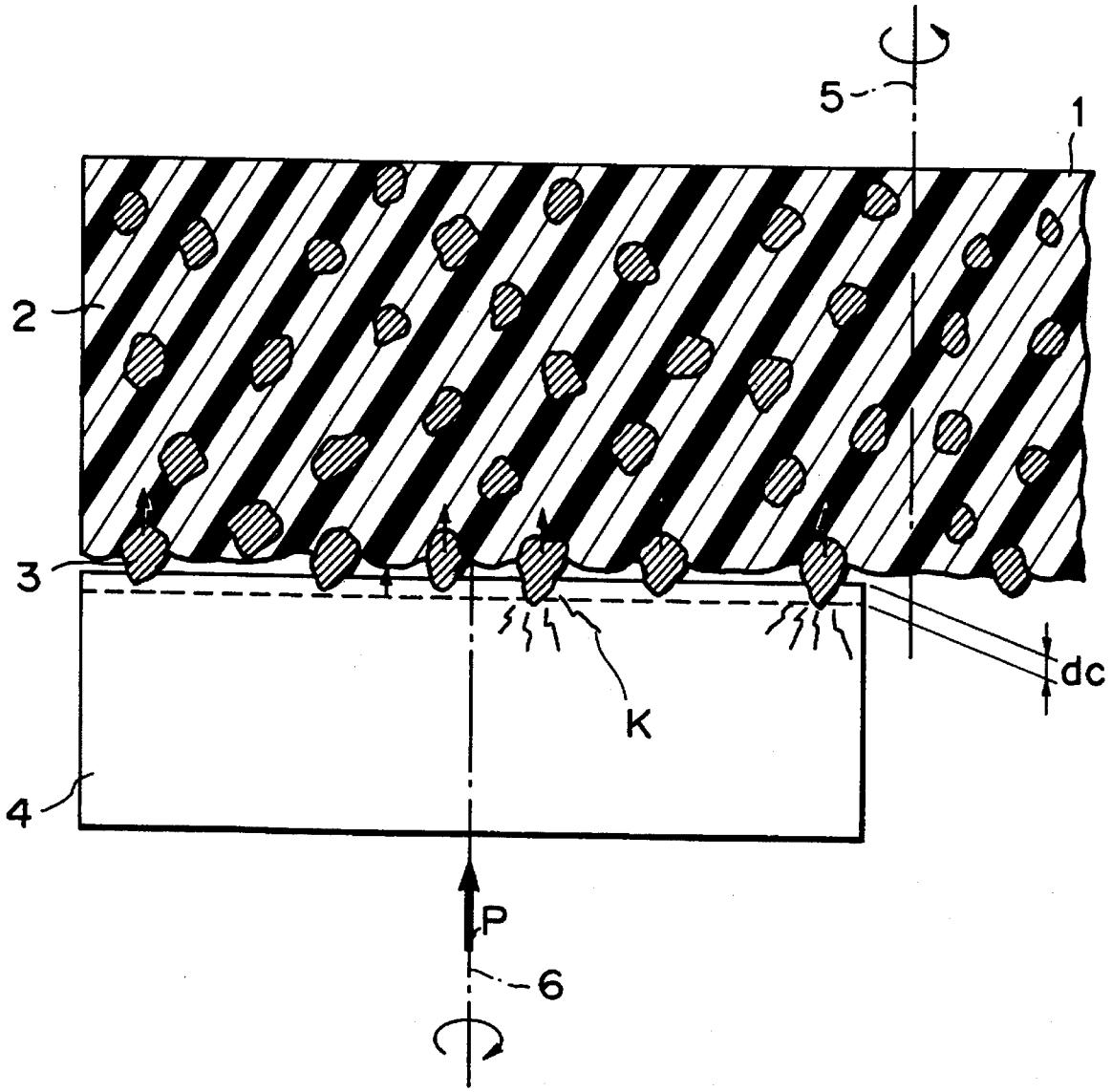
FIG. 11 is a schematic sectional view showing the state of grinding by a conventional resin-bonded grinding wheel.
Figure 12:
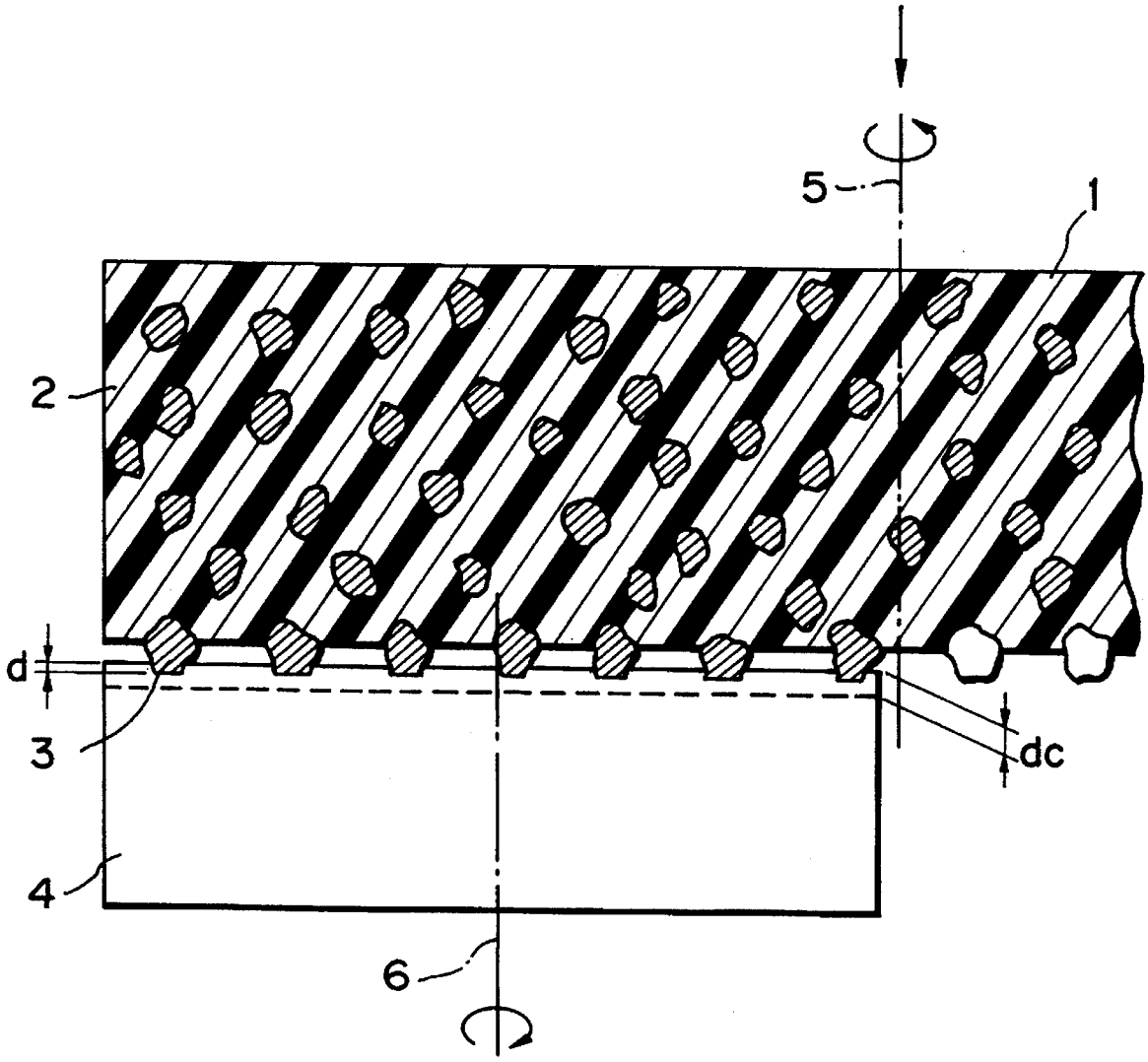
FIG. 12 is a schematic sectional view showing the state of grinding by conventional ductile-mode grinding.

FIG. 10 is a partially broken-away structural view showing an example of a lens spheric center oscillation movement type spherical surface processing machine for performing precision constant-pressure grinding of a spherical lens. The construction of this processing machine will now be described in simple terms.

A workpiece spindle housing 93 is mounted on a vertical positioning slide 91 so as to be free to move up and down. The housing 93 supports a spindle 94 of a workpiece in such a manner that the spindle 94 is free to turn and move up and down. A transmission belt 97 for rotating the spindle 94 is stretched between the spindle 94 and the output shaft of the workpiece rotating motor 96 secured to the housing 93. The spindle 94 is rotated by driving the motor 96. Though the details are not shown, the spindle 94 is hollow and a rotary seal (not shown) attached to the upper end thereof is connected to a vacuum pump (not shown) via a vacuum hose.

Secured to the lower end of the workpiece spindle 94 is a chuck 99 in which a workpiece 101 is mounted via a contact member 100. The workpiece 101 is attracted to the lower end of the spindle 94 by negative pressure generated by the vacuum pump. The contact member 100 is provided in order to absorb vibration of the workpiece 101 at the time of grinding and is made of rubber or the like. A grinding fluid supply nozzle 110 is provided above the workpiece 101 to supply it with a grinding fluid.

The intermediate portion of the spindle 94 is formed to have a flange 94*a*, and a pressure-setting screw 95 through which the spindle 94 is passed is threadedly engaged with the upper end (not shown) of the housing 93. A pressurizing coil spring 98 is provided between the flange 94 and the screw 95. As a result, the workpiece spindle 94 is biased downwardly in the drawing. When grinding is not being performed, i.e., when the workpiece spindle housing 93 is moved upward in the drawing, the flange 94*a* contacts a stopper 93*a* provided inside the housing 93, thereby limiting the position of the spindle 94.

At the time of grinding, on the other hand, the workpiece 101 comes into contact with the rotating grinding wheel 102, whereby the flange 94*a* of the workpiece spindle 94 separates from the stopper 93*a* in the housing 93 to compress the pressurizing coil spring 98. As a result, the workpiece 101 is pressurized toward the grinding wheel 102 at the overall load P. The method of setting the overall load P entails setting an initial amount of compression $l_1$ of the pressurizing spring 98 by adjusting the pressure setting screw 95, setting an amount of machining compression $l_2$ by positionally adjusting the housing 93 at the time of grinding, and finding P from the spring modulus K of the coil spring 98 through the formula $P=K\times(l_1+l_2)$.

A tool spindle 104 is attached below the workpiece spindle 94 via a rocking plate 107, a belt for rotating the spindle 104 is stretched between the spindle 104 and the output shaft of a tool rotating motor 105 mounted on the rocking plate 107, and the spindle 104 is rotated by driving the motor 105.

The rocking plate 107 is capable of being rocked about a rocking shaft (not shown) by a rocking-shaft drive motor (not shown) and can be rocked within set limits at the time of machining.

The thickness of a tool mounting member 103 is adjusted so as to situate the center of the spherical surface of the grinding wheel 102 at the point of intersection between the central axis of the rocking shaft and the central axis of the workpiece spindle 104, and the grinding wheel 102 is attached to the spindle 104 by screws, not shown.

When grinding is performed using the arrangement described above, first the housing 93 is moved upward in the drawing by the vertical positioning slide 91 to place the chuck 99 in a state in which it is spaced sufficiently far from the grinding wheel 102, the workpiece 101 is mounted in the chuck 99 via the contact member 110 and the workpiece is attracted by the negative pressure from the vacuum pump (not shown). Next, the housing 93 is moved downward in the drawing by the vertical positioning slide 91, the workpiece 101 is made to approach the grinding wheel 102 and the housing is lowered further even after the workpiece 101 contacts the grinding wheel 102. When this is done, the flange 94*a* separates from the stopper 93*a* and the workpiece 101 is pressurized toward the grinding wheel 102 in the manner set forth above. Movement of the housing 93 is halted at a position at which the flange 94*a* separates from the stopper 93*a* by the aforementioned amount of machining compression $l_2$. Under these conditions the workpiece rotating motor 96 and the tool rotating motor 105 are driven to grind the workpiece 101 while the grinding fluid supply device sprays the grinding fluid toward the workpiece 101 and grinding wheel 102.

In order to prevent eccentric wear of the grinding wheel 102 at grinding of the workpiece 101, the grinding wheel 102 may be rocked around the rocking shaft (not shown), namely the center of the spherical surface of the grinding wheel 102, as necessary.

The spherical lens constituting the workpiece used in this embodiment had a ϕ10, R30 convex surface and was made of heavy flint glass PBH6 manufactured by Ohara K.K.

The following measurements and calculations were performed before actually machining the spherical lens:

(1) Measurement of critical depth of cut $d_c$ and critical load $p_c$ of PBH6 glass Critical depth of cut was found using diamond abrasive grains having an average particle diameter of 50 μm in the first apparatus 200 shown in FIG. 3A, and a curve of d vs. p similar to that of FIG. 4 was obtained. As a result, with PBH6 glass, it was found that critical depth of cut $d_c$ equaled approximately 0.8 μm and that the load $p_c$ at this time was an average of 0.049N (0.005 kgf).

(2) Measurement of maximum number of active abrasive grains ($N_{MAX}$)

A planar grinding wheel having specifications (nickel bond; diamond having an average particle diameter of 50 μm) identical with those of the spherical grinding wheel used was fabricated, the planar grinding wheel was cut to a depth of 0.8 μm (the above-mentioned measured value of $d_c$) to scratch the acrylic resin using the second apparatus 300 (FIG. 5) for measuring the number of active abrasive grains, and the maximum number of active abrasive grains per square centimeter was measured. The value obtained was about 500 particles/$cm^2$.

Surface area M of the spherical lens is given by the following equation:

$$M=2\pi R\ [R-\{R^2-(d/2)^2\}]^{1/2} \qquad \text{Eq. (3)}$$

where R represents radius of curvature and d is the outer diameter.

Accordingly, if this value is substituted into Equation (3), M=0.79 $cm^2$ is obtained for a spherical surface of outer diameter ϕ10 and R30. This means that the maximum number of abrasive grains ($N_{MAX}$) on the grinding wheel surface that take part in grinding is 500×0.79=395 (particles).

In view of the foregoing results, the overall load at the critical depth of cut is 395×0.005=1.975 (kgf). Accordingly, if grinding is carried out while holding the overall load P at the time of machining below 1.975 (kgf), $d<d_c$ will hold and grinding can be performed in the ductile mode.

Constant-pressure grinding of a spherical lens (PHB6; a convex surface of ϕ10 and R30) was performed under the following machining conditions:

total load P: 1.5 kgf
grinding wheel rotational speed: 6000 rpm
lens rotational speed: 100 rpm
angle of oscillation: 5~15°
grinding fluid: soluble-type aqueous grinding solution diluted 100 times in accordance with W2, No.2 of JISK 2241

As a result, the surface of the workpiece after grinding was a ductile mode-ground surface having a surface roughness Rmax of 0.1 μm, and the amount of workpiece removal (the amount of reduction in thickness of the lens measured from the center thereof) was 10 μm in a machining time of 30 sec.

Further, 500 lenses were machined under the same conditions. A stable surface roughness and amount of removal were obtained and no wear of the abrasive grains in the grinding wheel could be found.

Second Embodiment

The flowchart of FIG. 9 relates to a second embodiment of the present invention. Here fine grinding was carried out not by the conventional resin-bonded grinding wheel but by using an electrodeposited-type bond grinding wheel of spherical shape having about 3000 active abrasive grains the heights of the tips of which were all precisely uniform at 0.1 μm. Measurement of the number of active abrasive grains was performed by directly observing the surface of the grinding wheel using a microscope or the like, counting the abrasive grains over a fixed surface area, expressing this in terms of the area of contact between the grinding wheel and the lens and adopting this number as the number of active abrasive grains.

The abrasive grains were diamond abrasive grains having an average diameter of 100 μm. The processing apparatus was a lens spheric center oscillation movement type spherical surface processing machine similar to that of the first embodiment and machining was performed at a constant pressure. The spherical lens serving as the workpiece had a ϕ10, R30 concave surface and was made of crown glass BSL7 manufactured by Ohara K.K.

Before the spherical lens was actually machined, $p_c$ was measured just as in the first embodiment. It was found that $p_c$ was 0.078 (8 gf). As a result, the load was set so as to be less than this value. More specifically, the overall load applied to the grinding wheel at this time was made 98N (10 kgf), and machining was carried out under the following conditions so as to make the load per abrasive grain about 0.033N (3.4 gf):

grinding wheel rotational speed: 5000 rpm
lens rotational speed: 1000 rpm
angle of oscillation: 5~15°
grinding fluid: soluble-type aqueous grinding solution diluted 100 times in accordance with W2, No.2 of JISK 2241

As a result, despite the fact that the bond of the grinding wheel used was of the electrodeposited type and the grinding wheel employed abrasive grains having a large average diameter of 100 μm, an excellent surface roughness could be obtained in less time than in the case of conventional resin-bonded fine grinding. More specifically, the roughness Rmax obtained was less than 0.1 μm (0.5 μm with the resin-bonded grinding wheel), and a ductile-mode ground surface was obtained over the entire lens surface. Further, since machining could be performed under high-load conditions with a uniform height for the tips of the abrasive grains, the speed of removal in the fine grinding process itself was high, with the amount of removal (the amount of reduction in thickness of the lens measured from the center thereof) being 15 μm in a machining time of 10 sec. Further, since machining was performed with a multiplicity of abrasive grains and a uniform height for the tips of the abrasive grains, the particles sustained little wear and over 5000 lenses could be machined stably.

Thus, as described above, by performing grinding set forth in each of the above embodiments, excellent surface roughness could be obtained at a higher efficiency than with fine grinding according to the prior art. This makes it possible to shorten the manufacturing process. Further, by using a hard-bond electrodeposited grinding wheel or metal-bonded grinding wheel at the time of fine grinding, there is no change in the shape of the grinding wheel and no deterioration in the cutting sharpness of the grinding wheel, and a large number of brittle materials can be machined in a stable manner.

Further, the grinding in each embodiment is essentially different from the conventional "ductile-mode grinding". Costly special-purpose machinery designed especially for ductile-mode grinding is not used. Rather, use is made of an inexpensive grinding machine such as the conventional constant-pressure grinding machine to enable machining at a high precision and high stability that compare with the precision and stability of conventional "ductile-mode grinding". Accordingly, manufacturing cost for machining brittle materials can be reduced in comparison with the prior art.

Thus, in accordance with the invention as described above, there is provided a method and apparatus for grinding brittle materials in which it is possible to perform grinding satisfactorily in the ductile mode region even if an ordinary grinding apparatus is used.

Other features and advantages of the present invention will be apparent from the following description taken in conjunction with the accompanying drawings, in which like reference characters designate the same or similar parts throughout the figures thereof.

The present invention is not limited to the above embodiments and various changes and modifications can be made within the spirit and scope of the present invention. Therefore, to apprise the public of the scope of the present invention the following claims are made.

What is claimed is:

1. A brittle-material machining method for grinding or polishing a worked surface of a workpiece having a brittle material, comprising the steps of:

effecting relative movement between the workpiece and a grinding tool comprising innumerable abrasive grains provided on a support base; and bringing the grinding tool into pressured contact with the worked surface at an overall load P during the relative movement to perform grinding or polishing, wherein the grinding or polishing is performed while satisfying a condition $P<N_{MAX}\cdot p_c$, where:

$N_{MAX}$ represents a maximum number of active abrasive grains present in an area of contact between the grinding tool and the workpiece when the grinding tool has cut into the worked surface in such a manner that a depth of cut d, into the worked surface, of active abrasive grains among the innumerable number of abrasive grains that participate in the grinding or polishing attains a critical depth of cut $d_c$, which is a minimum depth of cut at which brittle fracture is produced in the workpiece, and $p_c$ represents a critical load per one abrasive grain when the one abrasive grain has cut into the worked surface at the critical depth of cut $d_c$.

2. The method according to claim 1, wherein the workpiece has a fracture and toughness value $K_{IC}$ of less than 10 meganewton/$m^{3/2}$, and the worked surface is subjected to grinding or polishing as the grinding tool and the workpiece are moved relative to each other.

3. The method according to claim 1, wherein the grinding tool is one in which the heights of tips of the innumerable abrasive grains provided on the support base are made uniform, to a high degree of accuracy, at a level below the critical depth of cut $d_c$.

4. The method according to claim 1, wherein the grinding tool is one in which average particle diameter of the abrasive grains is more than 20 μm and hardness of a holding material is greater than a Vickers hardness of 300.

5. The method according to claim 1, wherein the workpiece is formed from any one of glass, crystal material and ceramic material.

6. The method according to claim 5, wherein the workpiece is any one of an optical lens, optical mirror and optical prism.

7. The method according to claim 5, wherein the worked surface of the workpiece is a flat surface or a spherical surface having a prescribed curvature.

8. A brittle-material machining method for grinding or polishing a worked surface of a workpiece having a brittle material by relative movement between the workpiece and a grinding tool comprising innumerable abrasive grains provided on a support base, while bringing the grinding tool into pressured contact with the worked surface at an overall load P, said method comprising the steps of:

measuring a critical depth of cut $d_c$, which is a minimum depth of cut at which brittle fracture is produced in the workpiece;

counting a maximum number $N_{MAX}$ of active abrasive grains present in an area of contact between the grinding tool and the workpiece when the worked surface has been cut in by the critical depth of cut $d_c$;

measuring a critical load $p_c$ per one abrasive grain when the one abrasive grain has cut into the worked surface at the critical depth of cut $d_c$; and performing the grinding or polishing while satisfying a condition $P<N_{MAX}\cdot p_c$.

9. The method according to claim 8, wherein the grinding tool is one in which the heights of tips of the innumerable abrasive grains provided on the support base are made uniform, to a high degree of accuracy, at a level below the critical depth of cut $d_c$.

10. The method according to claim 8, wherein the grinding tool is one in which average particle diameter of the abrasive grains is more than 20 μm and hardness of a holding material is greater than a Vickers hardness of 300.

11. The method according to claim 8, wherein the workpiece is formed from any one of glass, crystal material and ceramic material.

12. The method according to claim 11, wherein the workpiece is any one of an optical lens, optical mirror and optical prism.

13. The method according to claim 11, wherein the worked surface of the workpiece is a flat surface or a spherical surface having a prescribed curvature.

14. A brittle-material machining method for grinding or polishing a worked surface of a workpiece having a brittle material by relative movement between the workpiece and a grinding tool comprising innumerable abrasive grains provided on a support base, while bringing the grinding tool into pressured contact with the worked surface at an overall load P, wherein, in order to measure a critical depth of cut $d_c$, which is a minimum depth of a cut at which brittle fracture is produced in the workpiece, count a maximum number $N_{MAX}$ of active abrasive grains present in an area of contact between the grinding tool and the workpiece when the worked surface has been cut in by the critical depth of cut $d_c$;

measure a critical load $p_c$ per one abrasive grain when the one abrasive grain has cut into the worked surface at the critical depth of cut $d_c$; and perform the grinding or polishing while satisfying a condition $P<N_{MAX}\cdot p_c$, said method comprises the steps of:

fixing the one abrasive grain to a retainer, gradually cutting into the workpiece up to the critical depth of cut $d_c$ and measuring the critical load $p_c$ per one active abrasive grain at this time, this step being performed by a first apparatus;

forming scratches in a dummy workpiece by rotating the dummy through a prescribed angle to form scratches after the grinding tool comprising innumerable abrasive grains is made to cut into the dummy up to the critical depth of cut $d_c$, and obtaining the maximum number $N_{MAX}$ of active abrasive grains present in the area of contact between the grinding tool and the workpiece by counting the number of scratches, this step being performed by a second apparatus; and obtaining a condition $P<N_{MAX} \cdot p_c$.

15. The method according to claim 14, wherein the grinding tool is one in which the heights of tips of the innumerable abrasive grains provided on the support base are made uniform, to a high degree of accuracy, at a level below the critical depth of cut $d_c$.

16. The method according to claim 14, wherein the grinding tool is one in which average particle diameter of the abrasive grains is more than 20 μm and hardness of a holding material is greater than a Vickers hardness of 300.

17. The method according to claim 14, wherein the workpiece is formed from any one of glass, crystal material and ceramic material.

18. The method according to claim 17, wherein the workpiece is any one of an optical lens, optical mirror and optical prism.

19. The method according to claim 17, wherein the worked surface of the workpiece is a flat surface or a spherical surface having a prescribed curvature.

20. A brittle-material machining method comprising the steps of:

providing a contoured grinding tool, which comprises innumerable abrasive grains provided on a support base, on a grinding tool shaft disposed in a rocking mechanism, wherein tips of the innumerable abrasive grains define an envelope having a spherical shape whose radius of curvature is obtained by replicating a target value of a radius of curvature along a worked surface of a workpiece;

supporting the workpiece on a support portion provided on a workpiece pressurizing mechanism; and performing grinding or polishing by rotating the workpiece and the grinding tool relative to each other and rocking the same while satisfying a condition $P<N_{MAX} \cdot p_c$, where:

$N_{MAX}$ represents a maximum number of active abrasive grains present in an area of contact between the grinding tool and the workpiece when the grinding tool has cut into the worked surface to a critical depth of cut $d_c$, which is a minimum depth of cut at which brittle fracture is produced in the workpiece, and $p_c$ represents a critical load per one abrasive grain when the one abrasive grain has cut into the worked surface at the critical depth of cut $d_c$.

21. The method according to claim 20, wherein the shape of the workpiece is that of a spherical lens having a diameter D and a radius of curvature R as well as a surface area M defined by $$M=2\pi R\,[R-\{R^2-(D/2)^{1/2}], \text{ wherein}$$

the maximum number $N_{MAX}$ of active abrasive grains is made less than 3000 per surface area M, and grinding or polishing is performed at less than a critical depth of cut $d_c$ of the workpiece by rotating the workpiece and the grinding tool relative to each other and rocking the same.

22. A brittle-material machining method comprising the steps of:

machining a worked surface of a blank comprising a brittle material, which serves as a workpiece to be given a final, completed shape, into an approximate target shape by one or two grinding operations;

performing grinding or polishing while satisfying a condition $P<N_{MAX} \cdot p_c$ in order to grind or polish the worked surface by relative movement between the workpiece and a grinding tool composing innumerable abrasive grains provided on a support base while bringing the grinding tool into pressured contact with the worked surface of the workpiece at an overall load P, where:

$N_{MAX}$ represents a maximum number of active abrasive grains present in an area of contact between the grinding tool and the workpiece when the grinding tool has cut into the worked surface in such a manner that a depth of cut d, into the worked surface, of active abrasive grains among the innumerable number of abrasive grains that participate in the grinding or polishing attains a critical depth of cut $d_c$, which is a minimum depth of cut at which brittle fracture is produced in the workpiece, and $p_c$ represents a critical load per one abrasive grain when the one abrasive grain has cut into the worked surface at the critical depth of cut $d_c$; and performing final polishing by abrasive-free grains.

23. The method according to claim 22, wherein the workpiece is an optical element.

24. A brittle-material machining apparatus for grinding or polishing a worked surface of a workpiece having a brittle material, comprising:

a grinding tool comprising innumerable abrasive grains provided on a support base;

means for bringing said grinding tool into pressured contact with the worked surface at a prescribed pressure and effecting relative movement between said grinding tool and the worked surface, wherein the grinding or polishing is performed upon setting the prescribed pressure in such a manner that a depth of cut d, into the worked surface, of abrasive grains among said innumerable number thereof that participate in the grinding or polishing is made less than a critical depth of cut $d_c$, which is a minimum depth of cut at which brittle fracture is produced in the workpiece.

25. A brittle-material machining apparatus for grinding or polishing a worked surface of a workpiece having a brittle material, comprising a grinding tool comprising innumerable abrasive grains provided on a support base;

means for bringing said grinding tool into pressured contact with the worked surface at an overall load P and effecting relative movement between said grinding tool and the worked surface, wherein, the grinding or polishing is performed while satisfying a condition $P<N_{MAX} \cdot p_c$, where:

$N_{MAX}$ represents a maximum number of active abrasive grains present in an area of contact between said grinding tool and the workpiece when said grinding tool has cut into the worked surface in such a manner that a depth of cut d, into the worked surface, of active abrasive grains among said innumerable number of abrasive grains that participate in the grinding or polishing attains critical depth of cut $d_c$, which is a minimum depth of cut at which brittle fracture is produced in the workpiece, and $p_c$ represents a critical load per one abrasive grain when the one abrasive grain has cut into the worked surface at the critical depth of cut $d_c$.

26. A brittle-material machining apparatus, comprising:

a contoured grinding tool, which comprises innumerable abrasive grains provided on a support base, provided on a grinding tool shaft disposed in a rocking mechanism, wherein tips of said innumerable abrasive grains define an envelope having a spherical shape whose radius of curvature is obtained by replicating a target value of a radius of curvature along a worked surface of a workpiece;

a workpiece pressurizing mechanism having a support portion for supporting the workpiece; and means for grinding or polishing by rotating the workpiece and said grinding tool relative to each other and rocking the same while satisfying a condition $P<N_{MAX} \cdot p_c$, where:

$N_{MAX}$ represents a maximum number of active abrasive grains present in an area of contact between said grinding tool and the workpiece when said grinding tool has cut into the worked surface to a critical depth of cut $d_c$, which is a minimum depth of cut at which brittle fracture is produced in the workpiece, and $p_c$ represents critical load per one abrasive grain when said one abrasive grain has cut into the worked surface at said critical depth of cut $d_c$.

* * * * *

UNITED STATES PATENT AND TRADEMARK OFFICE

CERTIFICATE OF CORRECTION

PATENT NO. : 5,573,447

DATED : November 12, 1996

INVENTOR(S) : Kozakai et al.

It is certified that error appears in the above-indentified patent and that said Letters Patent is hereby corrected as shown below:

ON THE TITLE PAGE:

[56] REFERENCES CITED:

FOREIGN PATENT DOCUMENTS, "3221970" should read --63-221970--, "516070" should read --5-16070--, and "5185372" should read --5-185372--.

COLUMN 8:

Line 62, "countered" should read --counted--.

COLUMN 15:

Line 58, "$M=2\pi R\ [R-\{R^2-(D/2)^{1/2}]$," should read --$M=2\pi R\ [R-\{R^2-(D/2)^2\}^{1/2}]$,--.

Signed and Sealed this

Tenth Day of June, 1997

Bruce Lehman

*Attest:*

BRUCE LEHMAN

*Attesting Officer*

*Commissioner of Patents and Trademarks*